US006231420B1

(12) United States Patent
Lin

(10) Patent No.: US 6,231,420 B1
(45) Date of Patent: May 15, 2001

(54) HULA RING STRUCTURE

(76) Inventor: Reh-Shong Lin, No. 11, Jungle Rd., Dadu Shiang, Taichung (TW)

( * ) Notice: Subject to any disclaimer, the term of this patent is extended or adjusted under 35 U.S.C. 154(b) by 0 days.

(21) Appl. No.: 09/488,840

(22) Filed: Jan. 21, 2000

(51) Int. Cl.[7] ..... A63H 1/00; A63B 21/00

(52) U.S. Cl. ..... 446/236; 446/239; 446/241; 482/131

(58) Field of Search ..... 446/236, 239, 446/241; 482/131; 601/118, 132

(56) References Cited

U.S. PATENT DOCUMENTS 4,380,885 * 4/1983 Komagata .
5,997,449 * 12/1999 Lee ..... 482/131

* cited by examiner

*Primary Examiner*—Jacob K. Ackun, Jr.
*Assistant Examiner*—Bena B. Miller
(74) *Attorney, Agent, or Firm*—Rosenberg, Klein & Lee

(57) ABSTRACT

A hula ring includes a ring-shaped body and a plurality of recesses defined in an inside of the ring-shaped body. Each recess receives a roller therein which rolls on a user's body when the hula ring contacts the user's body.

2 Claims, 5 Drawing Sheets

HULA RING STRUCTURE

FIELD OF THE INVENTION

The present invention relates to a hula ring, and more particularly, to an improved hula ring having a plurality of rollers rotatably engaged to an inside of the ring-shaped body so that when the rollers contact the user's body, the rollers roll over the user's body a long distance.

BACKGROUND OF THE INVENTION

A conventional hula ring is used to be an exercise tool and generally is a ring-shaped body. The user shakes his/her waist to be circular action to let the hula be ring go around the waist. In order to enhance the massaging feature to the user, some hula rings have protrusions extending radially inward from an inside of the hula ring so that the protrusions will contact the user's body to achieve the purpose of massaging the user's waist. Nevertheless, it is experienced that the protrusions hurt the user who is thin. That is because the protrusions integrally extend from the hula ring so that the protrusions impact the user's body directly. Furthermore, the protrusions are an impediment for the hula ring smoothly going around the user's body because they extend inward and are fixed.

The present invention intends to provide a hula ring that has a plurality of rollers rotatably mounted to an inside of the hula ring so that when the hula ring contact the user's body, the rollers rolls and the hula ring is easily to obtain enough eccentric force.

SUMMARY OF THE INVENTION

In accordance with one aspect of the present invention, there is provided a hula ring and comprising a ring-shaped body with a plurality of recesses defined in an inside of the ring-shaped body. Each recess has a roller received therein which rolls on a user's body when the hula ring contacts the user's body.

The object of the present invention is to provide a hula ring that has rollers rotatably connected to an inside of the ring-shaped body of the hula ring so that the rollers help the user to let the hula ring go around the user's body.

Another object of the present invention is to provide a hula ring that will not hurt thin users.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
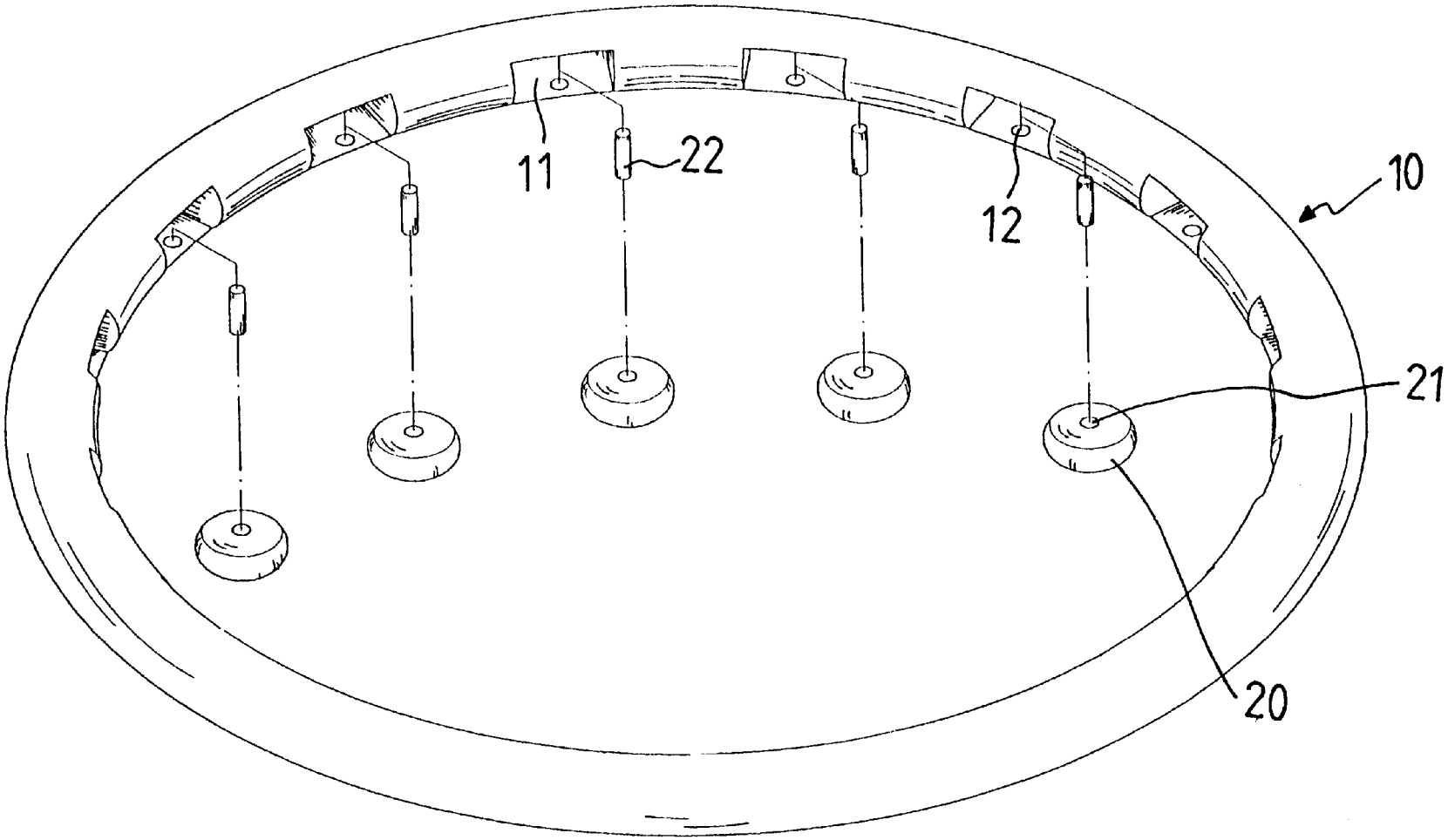
FIG. 1 is an exploded view to show a hula ring of the present invention.
Figure 2:
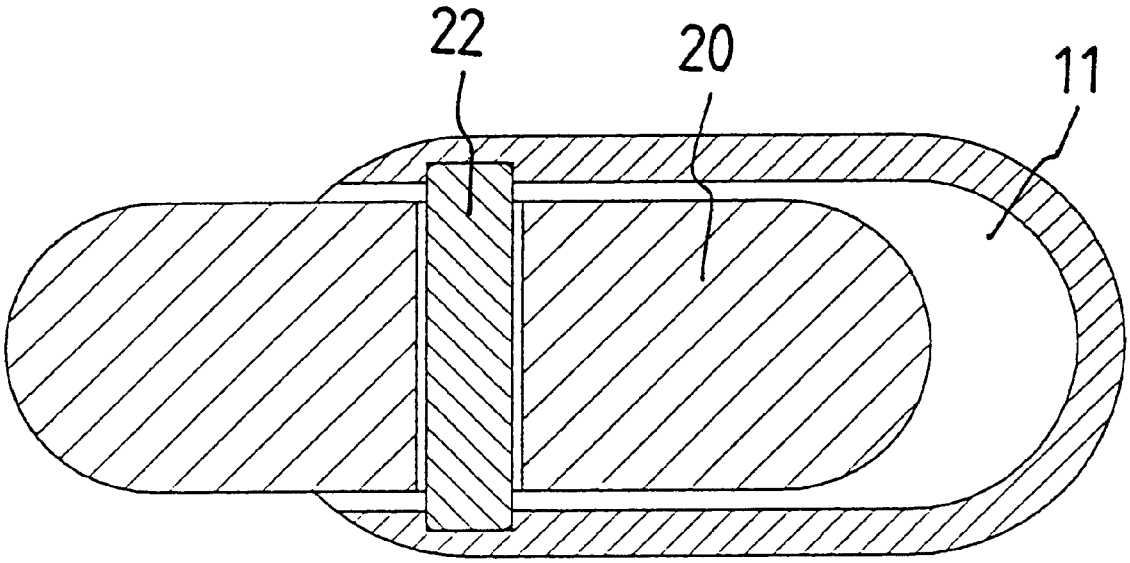
FIG. 2 is a side elevational view, partly in section, of the assembly of a roller received in a recess in the hula ring of the present invention.
Figure 3:
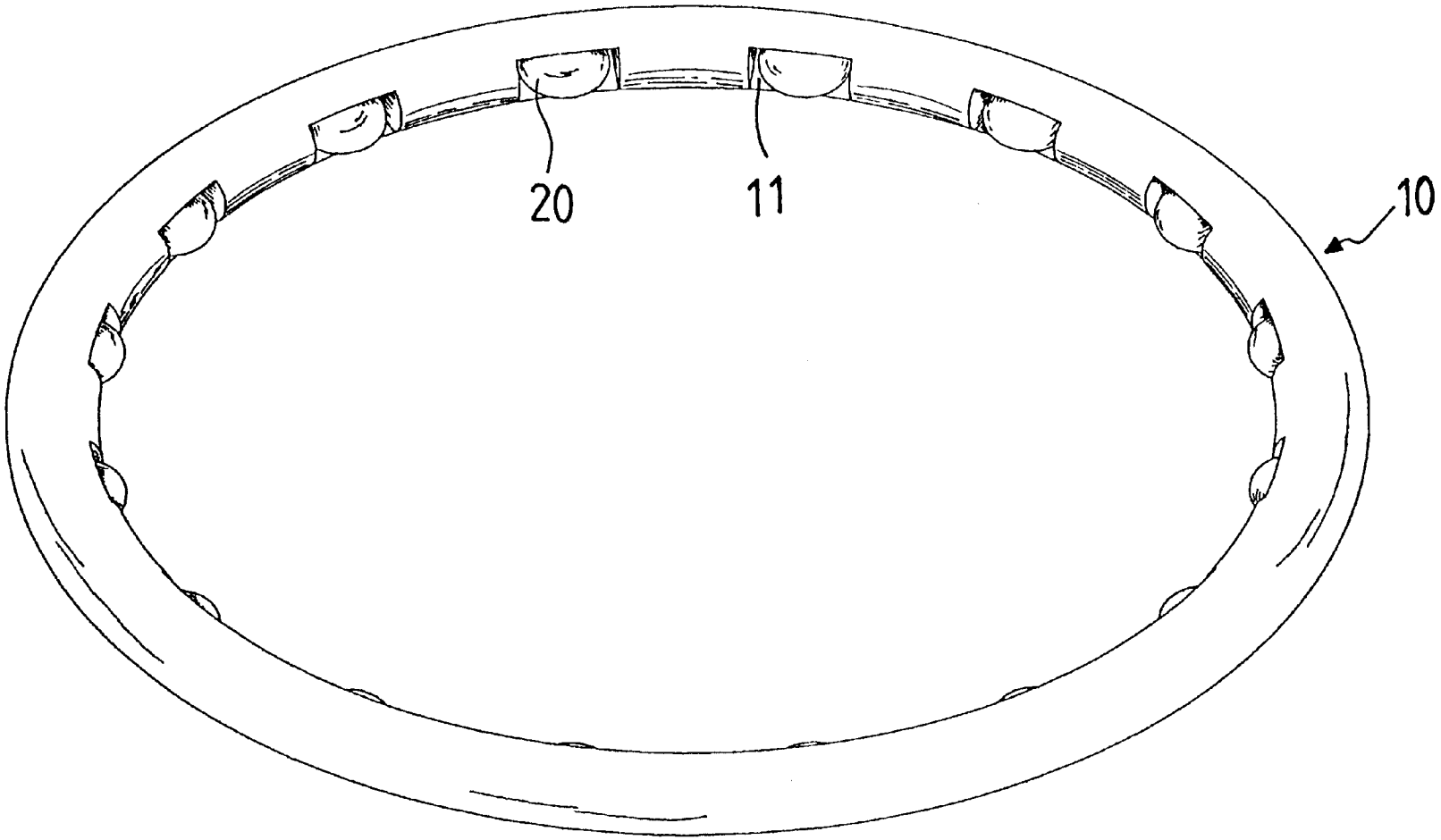
FIG. 3 is a perspective view to show the hula ring of the present invention.

Referring to FIGS. 1 to 3, the hula ring in accordance with the present invention comprises a ring-shaped body 10 having a plurality of recesses II radially defined in an inside of the body 10. Each recess 11 has two notches 12 defined in a top and a bottom defining the recess 11. A roller 20 is rotatably received in each recess 11 and is rotatable about a shaft 22 that extends through a passage 21 in the roller 20 and are engaged with the two notches 12 in the recess 11.

Therefore, when using the hula ring, the rollers 20 roll over the user's body so that the user will not feel pain even if the user is thin. Furthermore, the rollers 20 enhance the rotational speed of the hula ring so that a sufficient eccentric force is easily obtained.

Figure 4:
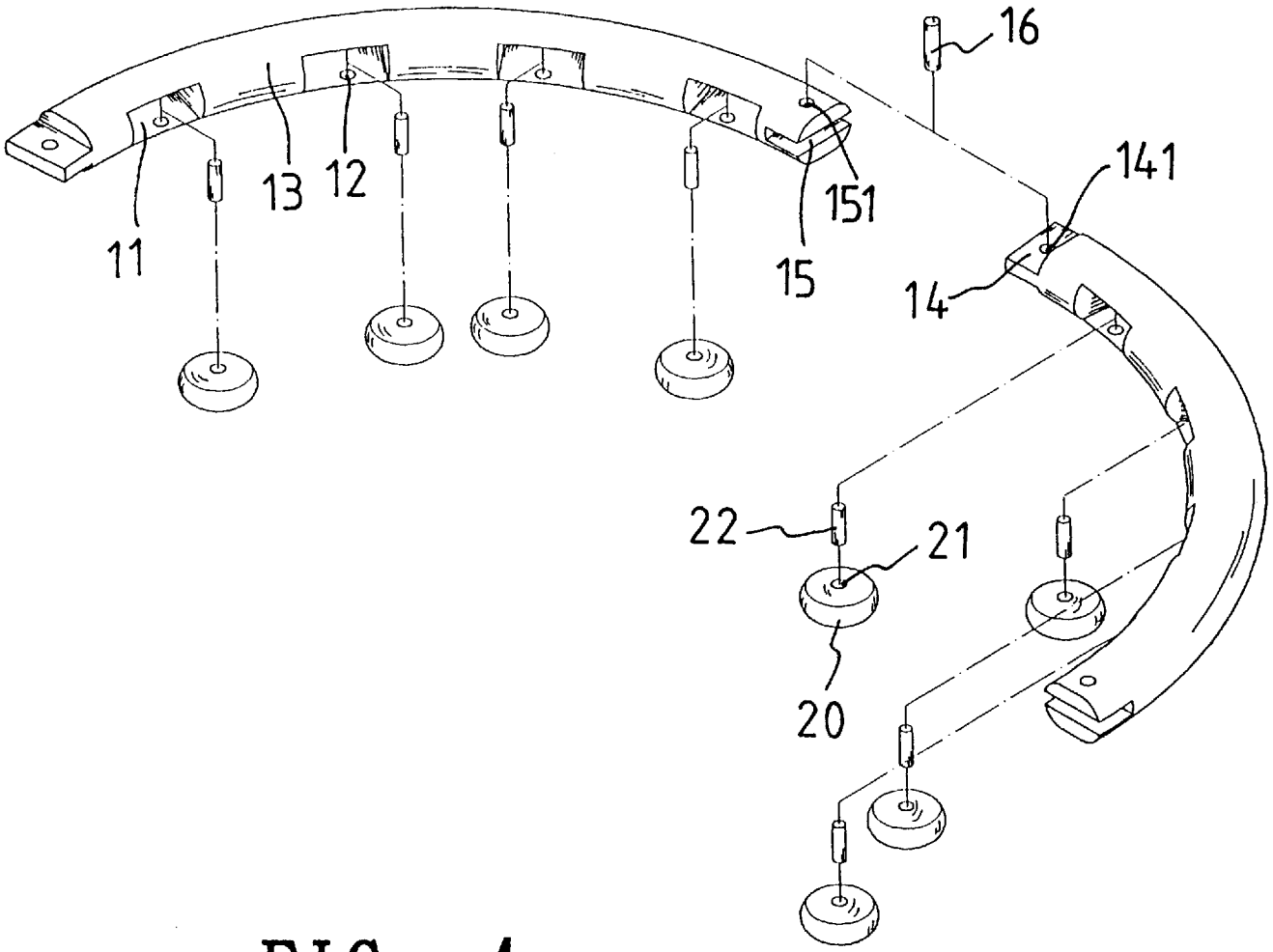
FIG. 4 is an exploded view to show the other embodiment of the hula ring of the present invention.
Figure 5:
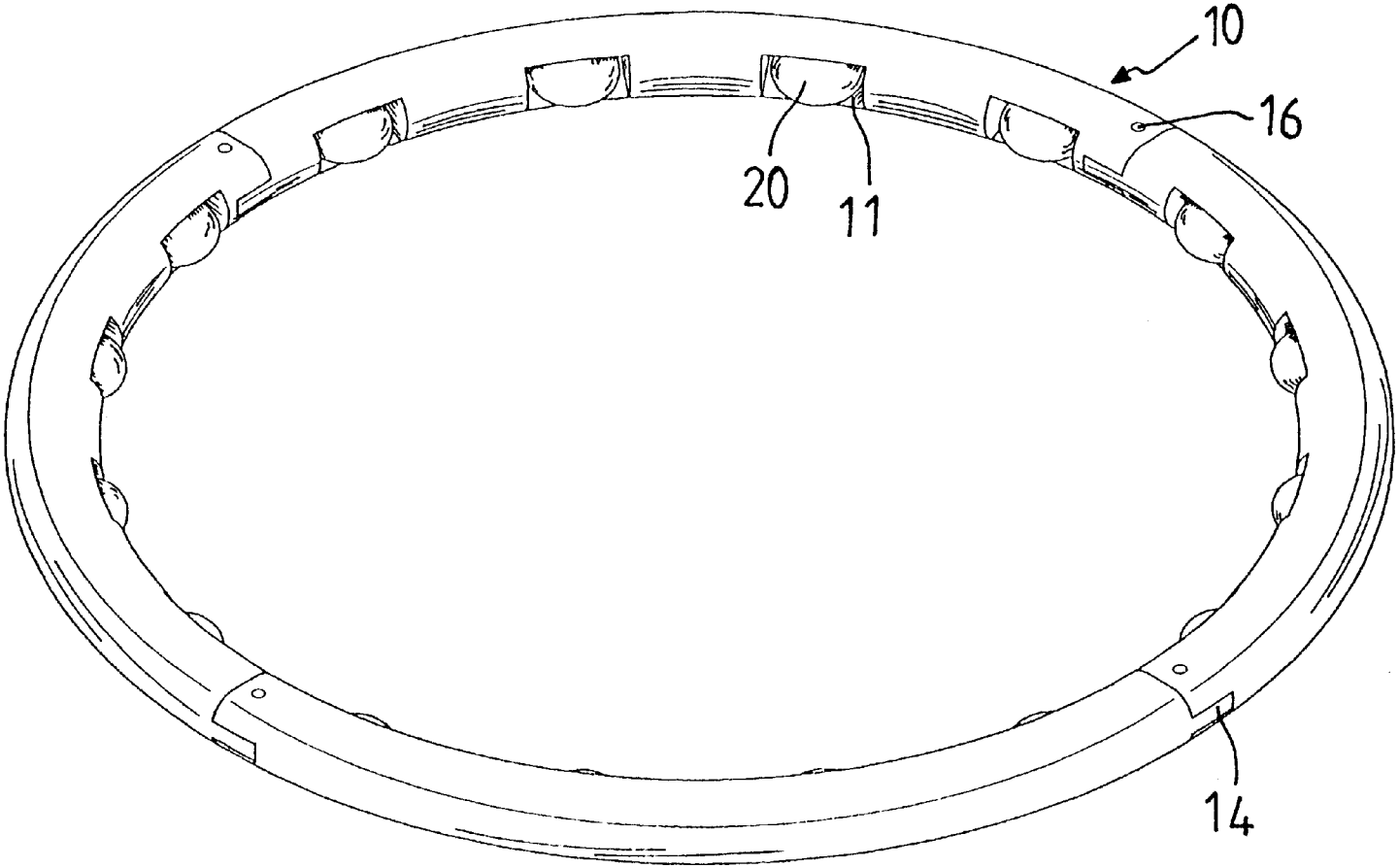
FIG. 5 is a perspective view to show the hula ring of the present invention as shown in FIG. 4.

Referring to FIGS. 4 and 5, the ring-shaped body 10 is composed of four arcuate sections 13, each one of the arcuate sections 13 having a first end and a second end. The first end of each arcuate section 13 is a tongue 14 and the second end has an engaging slot 15 defined therein. The tongue 14 of one of the arcuate sections 13 is engaged with the slot of the adjacent arcuate section 13 with a pin 16 extending through holes 151 defined through two partitions separated by the slot 15 and the hole 141 in the tongue 14. Each of the arcuate sections 13 has a plurality of recesses 11 radially defined in an inside of the body 10. Each recess 11 has two notches 12 defined in a top and a bottom defining the recess 11. A roller 20 is rotatably received in each recess 11 and is rotatable about a shaft 22 that extends through a passage 21 in the roller 20 and are engaged with the two notches 12 in the recess 11.

Therefore, the hula ring of the present invention improves the shortcomings of the conventional hula rings and the rollers 20 perform a massaging feature when rolling over the user's body.

While we have shown and described various embodiments in accordance with the present invention, it should be clear to those skilled in the art that further embodiments may be made without departing from the scope and spirit of the present invention.

What is claimed is:

1. A hula ring comprising:

a ring-shaped body which includes at least two arcuate sections, each one of said at least two arcuate sections having a first end and a second end, said first end being a tongue and said second end having an engaging slot defined therein, said tongue of one of said at least two arcuate sections engaged with said slot of the other one of said at least two arcuate sections, a pin extending through said second end of one of said at least two arcuate sections and said tongue of the other one of said at least two arcuate sections, a plurality of recesses radially defined in an inside of said body and each recess having a roller rotatably received therein.

2. The hula ring as claimed in claim 1, wherein said each roller has a shaft extending therethrough and said shaft is engaged with said recess.

* * * * *